United States Patent [19]

McCarty

[11] 4,445,343

[45] May 1, 1984

[54] SONIC RESTRICTOR MEANS FOR A HEAT PUMP SYSTEM

[75] Inventor: William J. McCarty, Louisville, Ky.

[73] Assignee: General Electric Company, Louisville, Ky.

[21] Appl. No.: 464,048

[22] Filed: Feb. 4, 1983

[51] Int. Cl.[3] ..... F25B 13/00

[52] U.S. Cl. ..... 62/324.1; 62/324.6; 62/504; 62/511

[58] Field of Search ..... 62/504, 511, 324.1, 62/324.6, 160

[56] References Cited

U.S. PATENT DOCUMENTS

| | | | |
|---|---|---|---|
| 2,694,296 | 11/1954 | Prosek et al. | 62/115 |
| 2,750,762 | 6/1956 | Coyne | 62/117.55 |
| 2,785,540 | 3/1957 | Biehn | 62/115 |
| 3,210,958 | 10/1965 | Coyne | 62/324.6 |
| 3,404,542 | 10/1968 | Fineblum | 62/324 |
| 3,702,144 | 11/1972 | Loveland | 138/44 |
| 4,359,874 | 11/1982 | McCarty | 62/117 |

*Primary Examiner*—Lloyd L. King

*Attorney, Agent, or Firm*—Frank P. Giacalone; Radford M. Reams

[57] ABSTRACT

A heat pump system comprising a compressor and two heat exchangers connected in a refrigerating circuit is provided with refrigerant flow restricting means between the heat exchangers which imparts relatively high restriction to the flow of refrigerant between the heat exchangers in one direction and a relatively lower restriction to the flow of refrigerant between the heat exchangers in the opposite direction.

8 Claims, 3 Drawing Figures

SONIC RESTRICTOR MEANS FOR A HEAT PUMP SYSTEM

BACKGROUND OF THE INVENTION

The present invention relates to restrictor means for heat pumps of the type comprising a compressor, condenser, evaporator refrigeration system in which refrigerant is compressed by the compressor, condensed in a heat exchanger functioning as the system condenser, and is then passed through a restrictor to a heat exchanger functioning to evaporate the condensed refrigerant and in so doing absorbs heat from the walls of the heat exchanger, after which the evaporized refrigerant is returned to the compressor.

It has been common practice to provide heat pump systems of the type referred to which include means for reversing the direction of flow of refrigerant from the compressor through the two heat exchangers so that the functions of the heat exchangers are reversed. Thus, one of the heat exchangers is adapted to heat or cool the air of a room, for example, according to the direction of flow of refrigerant. When the direction of flow of refrigerant is reversed, it is necessary to alter the degree of restriction between the two heat exchangers to provide for proper operation of the system in the alternative function, as is well understood in the art. Altering the degree of restriction relative to the direction of flow of refrigerant is necessary since a system optimized for cooling generally has insufficient restriction to provide optimum performance when operated to supply heat. That is, in a system optimized for cooling, the compressor will normally circulate refrigerant through the evaporator faster than the surface can evaporate the refrigerant when the system is operated in the heating cycle. The compressor in the heating cycle then pumps unevaporated refrigerant and the system efficiency is low. To overcome this, variable restriction systems have been employed in heat pump refrigeration systems. In many instances, two restrictors have been provided together with parallel valve systems, each of which is adapted to function in accordance with the direction of refrigerant flow.

It is, accordingly, an object of the present invention to provide a simple and inexpensive, yet effective, means to produce a relatively high restriction to the flow of refrigerant from one heat exchanger to the other during the heating cycle, and to produce a substantially lesser degree of restriction when the refrigerant flow is in the opposite direction between the heat exchangers during the cooling cycle.

DESCRIPTION OF THE PREFERRED EMBODIMENT

Figure 1:
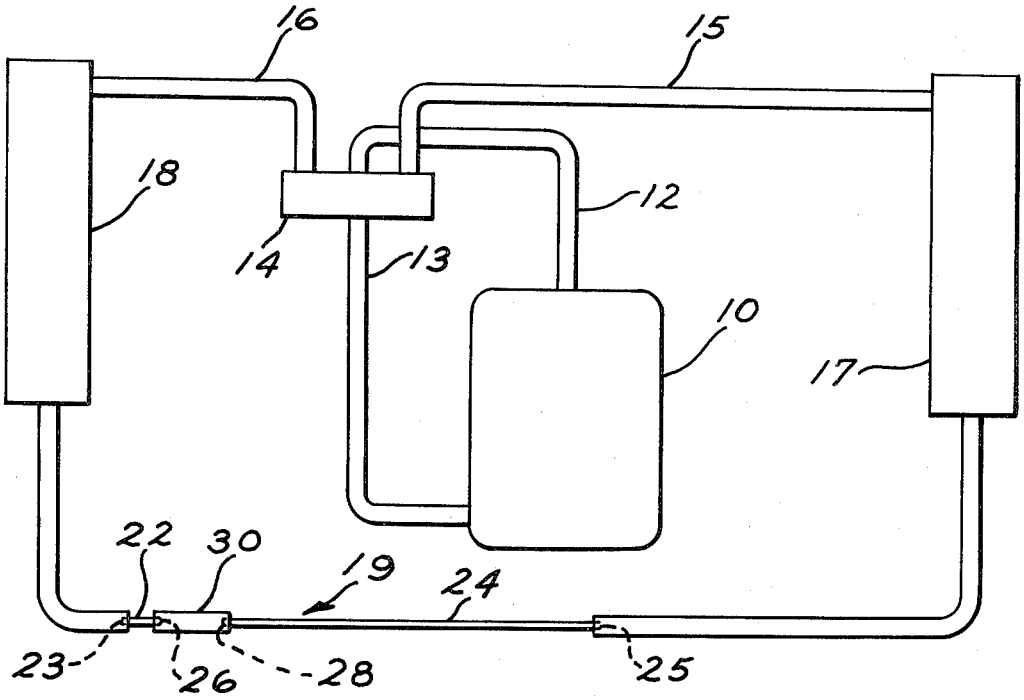
FIG. 1 is a schematic diagram of a closed reversible refrigeration system incorporating the present invention.

Referring now to the diagram of FIG. 1, there is shown therein a refrigeration system including a motor compressor 10 having a discharge line 12 and a suction line 13 connected thereto. The other ends of the discharge and suction lines are both connected to a reversing valve 14. Also connected to the reversing valve 14 are a pair of conduits 15 and 16 which lead respectively to indoor and outdoor heat exchangers or coils 17 and 18. The indoor coil 17 is arranged for heating or cooling the air in the enclosure to be conditioned, and the outdoor coil 18 is arranged for either rejecting heat to, or picking it up from, the outside atmosphere.

The reversing valve 14 is operatively controlled in any known manner to selectively connect the discharge line 12 and suction line 13 of the compressor 10 to conduits 15 and 16 and thus to the indoor and outdoor coils 17 and 18, respectively. Or it may be operated to reverse that connection and connect the discharge line 12 to the outdoor heat exchanger 18 and the suction line 13 to the indoor coil 17. More specifically, if it is desired to set the system for a heating cycle, the compressor discharge is connected to the indoor coil 17 through the conduit 15 and the suction line 13 is connected to the outdoor coil 18 through the conduit 16; whereas, if it is desired to initiate a cooling cycle, the discharge line 12 is connected to the outdoor coil 18 through the conduit 16 and the suction line 13 is connected to the coil 17 through conduit 15.

By the present invention, a capillary system 19 is provided for the purpose of expanding the refrigerant from condensing pressure to evaporating pressure in both the heating or cooling cycle. The capillary system 19 is so dimensioned and arranged that an efficient flow rate is obtained in the system in both flow directions during the heating and cooling cycles. More specifically, the present capillary system offers more restriction to the flow of refrigerant during the heating cycle than during the cooling cycle, whereby a lesser amount of refrigerant flows between the heat exchange coils during the heating cycle.

As is well understood in the art, during operation of the refrigeration system in the heating cycle, considerably more restriction to the flow of refrigerant from the indoor heat exchanger 17 functioning as the system condenser to the outdoor heat exchanger 18 functioning as the system evaporator is required. This is because the relatively cooler outdoor air passing over the outdoor heat exchanger functioning as the evaporator causes a lower suction pressure which reduces the compressor capacity and refrigerant flow rate. Accordingly, the present capillary system functions to provide substantially less refrigerant flow in the heating cycle relative to the cooling cycle.

In carrying out the capillary system of the present embodiment in the manner to be explained, the pressure velocity indicated in the enthalpy diagram and the flow rates mentioned herein were attained using R22 as the refrigerant. The capillary system in the present invention is, as will be explained, dimensioned in a manner that causes refrigerant flow in the heating cycle to attain sonic velocity. At sonic velocity, maximum flow of refrigerant is attained and the capillary opening is dimensioned to maintain refrigerant R22 at its sonic velocity and at a designed flow rate to allow the desired amount of refrigerant flow. It should be noted that once a fluid flowing through a restriction reaches sonic velocity, the maximum flow rate for refrigerant through that size restriction is established. Then, changing the size of the passageway will alter the flow rate; for example, making the restriction greater will maintain the fluid at its sonic velocity but the flow rate or amount of fluid flowing therethrough will decrease. If the opening or restriction were to increase whereby fluid flow is below sonic velocity, then the flow rate or amount of fluid flow therethrough would increase. The capillary system as designed allows fluid to attain sonic velocity in one flow direction and, accordingly, be limited to the designed maximum while flow in the other direction remains below sonic velocity, and, since it is not limited by sonic velocity, the flow rate is higher. This arrangement, as will be explained fully, provides the desired flow rate for either the heating or cooling flow direction.

Figure 2:
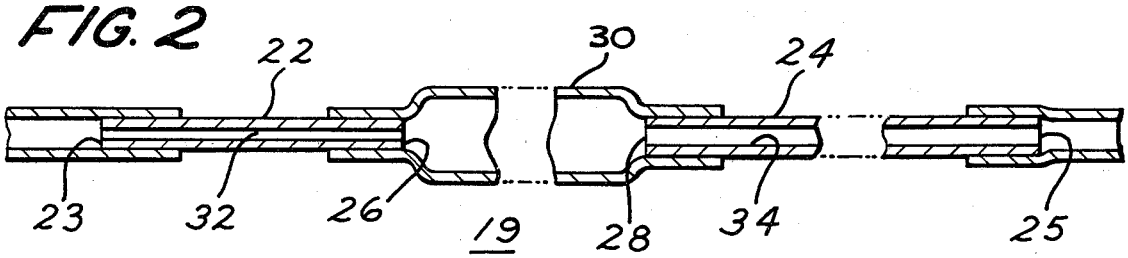
FIG. 2 is an enlarged view partially in section of the capillary system forming part of the refrigeration system.

Referring to the drawings and more particularly to FIG. 2, it will be seen that the capillary system 19 includes a first restrictor tube 22 connected at one end 23 for receiving refrigerant from the outdoor heat exchanger 18, and a second restriction tube 24 connected at one end 25 for receiving refrigerant from the indoor heat exchanger 17. Connected to the other ends 26 and 28 of the restrictor tubes 22 and 24, respectively, is a volume 30 through which refrigerant flows from one restrictor to the other. In carrying out the present embodiment, tube 22 is approximagely one (1) inch in length with a passageway 32 having an inside diameter of 0.042 inches. The tube 24 is approximately ten (10) inches in length with a passageway 34 having an inside diameter of 0.059 inches.

Figure 3:
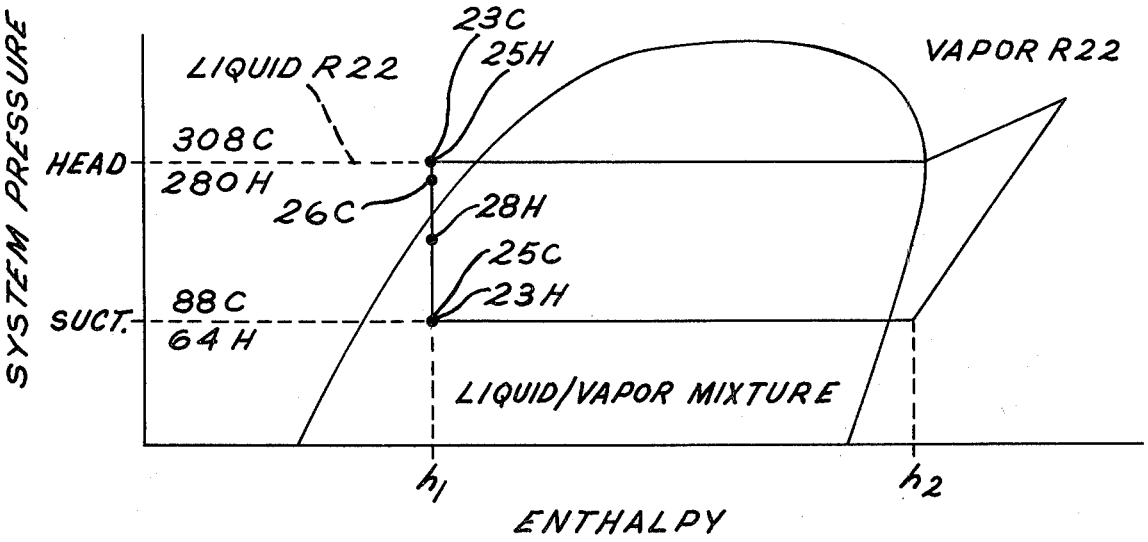
FIG. 3 is a pressure enthalpy diagram showing the function of the capillary system of the present invention.

In operation with the heat pump in the cooling mode and, as explained above, the outdoor heat exchanger 18 functioning as the system condenser, the subcooled refrigerant in liquid state with a head pressure of 308 lbs., as shown in the enthalpy diagram of FIG. 3, enters end 23 and flows through passageway 32 of tube 22. The refrigerant exiting end 26 of tube 22, as shown in FIG. 3, is still in liquid state with a velocity of 60 ft/sec as it enters volume 30. Since the sonic velocity of R22 refrigerant in liquid state is approximately 400 ft/sec, refrigerant flow through tube 22 in this flow direction is not limited by sonic velocity. It should be noted the length and diameter of passageway 34 of tube 22 are dimensioned so that refrigerant will exit in liquid state since, as will be explained hereinafter, a gaseous/liquid mixture would attain its sonic velocity. The refrigerant then flows through passageway 34 of tube 24 and exits end 25 at a velocity of 323 ft/sec as a liquid/gaseous mixture at a suction pressure of 88 lbs. with a refrigerant flow rate of 144 lbs/hr. It should be noted that in this refrigerant flow direction the tubes 22 and 24 comprise the total restriction to the flow of refrigerant, with most of the restriction as shown in FIG. 3 taking place in the passageway 34 of tube 24. The capillary system in this refrigerant flow direction acts as a standard refrigeration system capillary wherein there is a constant enthalpy expansion process.

With the heat pump in the heating mode as explained above, the indoor heat exchanger 17 functions as the system condenser. Refrigerant in liquid state with a head pressure of 280 lbs, as shown in the enthalpy diagram, enters end 25 and then flows through passageway 34 of tube 24.

As shown in FIG. 3, refrigerant exiting end 28, because of the dimension of passageway 34 of tube 24, is in liquid/gaseous state and has a velocity substantially greater than the 60 ft/sec of the liquid refrigerant entering volume 30 in the cooling cycle, but still below its sonic velocity. The refrigerant in this liquid/gaseous mixture then flows through passageway 32 of tube 22 and, due to the dimension of passageway 32, exits end 23 at a velocity of approximately 425 ft/sec. This velocity is the sonic velocity of R22 refrigerant liquid/gaseous mixture. The refrigerant exiting passageway 32 is at a suction pressure of 64 lbs. and a refrigerant flow rate of 114 lbs/hr. This flow rate is less than the cooling flow rate which, as mentioned above, was 144 lbs/hr. As mentioned above, sonic velocity is the maximum flow rate of refrigerant through tube 22 and, accordingly, the flow rate in the heating cycle is determined by the dimension of the passageway 32 of tube 22.

Volume 30 is sized to insure that sufficient area is provided to allow the gas/liquid mixture in the heating cycle to reach equilibrium. In the present instance, the volume 30 had an inside diameter of 0.250 and a length of two (2) inches. It should be noted that all dimensions cited above are intended to show parameters used to carry out the present embodiment, and in carrying out other embodiments employing other refrigerants and refrigeration systems having different capacities and pressures, other parameters might be necessary.

The foregoing is a description of the preferred embodiment of the apparatus of the invention and it should be understood that variations may be made thereto without departing from the true spirit of the invention as defined in the appended claims.

What is claimed is:

1. A reversible refrigeration system adapted for heating and cooling, a compressor, an indoor heat exchanger and an outdoor heat exchanger connected in reversible refrigerant flow relationship, a valve for reversing the flow of refrigerant through said system to operate said system in a heating or cooling operation with each of said heat exchangers arranged interchangeably as a condenser or as an evaporator, restrictor means connected between said heat exchangers for expanding refrigerant from condenser pressure to evaporator pressure during both the heating and the cooling operation, said restrictor means dimensioned for interjecting greater flow restriction between said heat exchangers when flow of refrigerant is in one direction than when the flow of refrigerant is in the other direction, comprising:

a first member having a bore of predetermined length and diameter therethrough;

a second member having a bore of a greater predetermined length and diameter therethrough relative to said first member;

volume means connecting said first and second members in series flow arrangement;

said diameter and length of each of said bores being dimensioned so that in said cooling operation, refrigerant, because of the length and diameter of the bore of said first member, flows therethrough in liquid state at below its sonic velocity and then, due to the length and diameter of the bore of said second member, emerges therefrom in a gaseous/liquid state at below its sonic velocity and at the cooling operating flow rate, and in said heating operation, refrigerant, because of the length and diameter of the bore of said second member, flows therethrough as a gaseous/liquid mixture and then, due to the length and diameter of said bore of said first member, emerges at its sonic velocity thereby limiting the flow of refrigerant to the heating operation flow rate.

2. The refrigerator system recited in claim 1 wherein said volume means is dimensioned so that in said heating operation refrigerant flowing therethrough in gaseous/-liquid state will reach its equilibrium.

3. The refrigeration system recited in claim 1 wherein said bore in said first member is one inch in length with a diameter of 0.042 inches, and said bore in said second member is ten inches in length with a diameter of 0.054 inches.

4. The refrigeration system recited in claim 1 wherein the refrigerant emerging from said second member in the cooling operation has a velocity of 323 ft/sec at a flow rate of 144 lbs/hr and emerges from said first member in the heating operation at a velocity of 425 ft/sec and a flow rate of 114 lbs/hr.

5. A capillary system for use in a reversible refrigeration system adapted to be used in a cooling operation and a heating operation, said capillary system comprising:

a first member having a bore of predetermined length and diameter therethrough;

a second member having a bore of a greater predetermined length and diameter therethrough relative to said first member;

volume means connecting said first and second members in series flow arrangement;

said diameter and length of each of said bores being dimensioned so that in said cooling operation, refrigerant, because of the length and diameter of the bore of said first member, flows therethrough in liquid state at below its sonic velocity and then, due to the length and diameter of the bore of said second member, emerges therefrom in a gaseous/liquid state at below its sonic velocity and at the cooling operating flow rate, and in said heating operation, refrigerant, because of the length and diameter of the bore of said second member, flows therethrough as a gaseous/liquid mixture and then, due to the length and diameter of said bore of said first member, emerges at its sonic velocity thereby limiting the flow of refrigerant to the heating operation flow rate.

6. The capillary system recited in claim 5 wherein said volume means is dimensioned so that in said heating mode refrigerant flowing therethrough in gaseous/liquid state will reach its equilibrium.

7. The capillary system recited in claim 5 wherein said bore in said first member is one inch in length with a diameter of 0.042 inches, and said bore in said second member is ten inches in length with a diameter of 0.054 inches.

8. The capillary system recited in claim 5 wherein the refrigerant emerging from said second member in the cooling operation has a velocity of 323 ft/sec at a flow rate of 144 lbs/hr and emerges from said first member in the heating operation at a velocity of 425 ft/sec and a flow rate of 144 lbs/hr.

* * * * *

UNITED STATES PATENT AND TRADEMARK OFFICE

CERTIFICATE OF CORRECTION

PATENT NO. : 4,445,343

DATED : May 1, 1984

INVENTOR(S) : William J. McCarty

It is certified that error appears in the above-identified patent and that said Letters Patent is hereby corrected as shown below:

Column 6, Line 27, delete "144" and insert --114--.

Signed and Sealed this

*Second* Day of *October 1984*

[SEAL]

*Attest:*

GERALD J. MOSSINGHOFF

*Attesting Officer*

*Commissioner of Patents and Trademarks*